United States Patent [19]

Key et al.

[11] Patent Number: 4,701,143

[45] Date of Patent: Oct. 20, 1987

[54] VESSEL MOORING SYSTEM AND METHOD FOR ITS INSTALLATION

[75] Inventors: Joe W. Key, Magnolia; Fred E. Shumaker, Houston, both of Tex.

[73] Assignee: Key Ocean Services, Inc., Magnolia, Tex.

[21] Appl. No.: 857,041

[22] Filed: Apr. 29, 1986

Related U.S. Application Data

[63] Continuation-in-part of Ser. No. 661,690, Oct. 17, 1984.

[51] Int. Cl.[4] ..... E21B 43/01

[52] U.S. Cl. ..... 441/5; 114/264; 405/202; 166/355

[58] Field of Search ..... 441/3, 5, 133; 114/264, 114/230, 144 B, 293; 405/202; 166/355, 356, 350; 175/7

[56] References Cited

U.S. PATENT DOCUMENTS

| | | | |
|---|---|---|---|
| 3,189,098 | 6/1965 | Haeber | 166/355 |
| 3,196,958 | 7/1965 | Travers | 166/355 |
| 3,525,312 | 8/1970 | Beck | 441/5 |
| 3,602,302 | 8/1971 | Kluth | 166/366 |
| 3,605,688 | 9/1971 | Morgan | 441/3 |
| 3,620,181 | 11/1971 | Naczowski | 441/3 |
| 3,722,584 | 3/1973 | Nelson | 166/355 |
| 4,321,720 | 3/1982 | Havre | 441/5 |
| 4,571,125 | 2/1986 | Oshima | 405/224 |

FOREIGN PATENT DOCUMENTS

| | | | |
|---|---|---|---|
| 1595045 | 8/1981 | United Kingdom | 21/50 |

*Primary Examiner*—Joseph F. Peters, Jr.
*Assistant Examiner*—Clifford T. Bartz
*Attorney, Agent, or Firm*—Steve Rosenblatt

[57] ABSTRACT

The present invention provides a vessel mounted mooring system and a method for its installation. The method involves the construction of a vertical well in the vessel extending from the deck through the bottom plates of the vessel. A lower bearing ring which circumscribes the well is connected to the underside of the bottom plates. A lower turret unit is laterally guided by the lower bearing ring and is restrained against uplift forces by the lower bearing ring. A middle turret unit is placed into the well and connected to the lower turret unit. An upper bearing ring which circumscribes the well is mounted to the deck. The upper turret unit is connected to the middle turret unit whereupon the weight of the assembly of the upper, middle and lower turret units is supported by the upper turret unit and is guided by the upper bearing ring. Chain lockers which include chains and windlasses are mounted to the upper turret unit for selectively paying out or reeling in chain through the upper, middle and lower turret unit to allow the chain to be connected near the subsea floor.

25 Claims, 2 Drawing Figures

VESSEL MOORING SYSTEM AND METHOD FOR ITS INSTALLATION

This application is a continuation-in-part application of application Ser. No. 661,690 filed Oct. 17, 1984 for a Vessel Mooring System and Method for Its Installation which is copending with this application.

FIELD OF THE INVENTION

This invention relates to a mooring apparatus for installation and use aboard a vessel.

BACKGROUND OF THE INVENTION

The offshore production of oil at substantial distances from land or in remote areas often makes it impractical to install a pipeline on the sea floor so that the oil produced from the offshore wells can be pumped directly to shore for storage and/or further transportation or processing. Oil produced under such circumstances is more conveniently delivered directly or by short feeder pipelines to a moored dedicated vessel, such as an oil tanker where it can be stored until transhipment. Mooring a vessel offshore for extended periods presents many problems, including anticipated storm conditions at the mooring location. It is desirable for mooring systems to permit the vessel to weathervane so that the vessel will always face into prevailing seas, current and wind. Because of anticipated storm conditions at potential mooring sites, it is generally not suitable to use conventional ship anchors and mooring lines for long term mooring because of the large size which would be required. A more suitable mooring system for an offshore vessel which permits it to weathervane, employs a pivoting assembly built into the vessel to allow for collection of oil/gas while the vessel is moved about or weathervanes (i.e. rotates).

In mooring vessels offshore it is important to keep a very accurate station. The importance of keeping an accurate station with respect to the ocean's floor is obvious when consideration is given to offshore drilling and the requirement that the drilling string, for example should be relatively stationary against ocean caused shear forces at all times. Production of hydrocarbons from subsea wells also requires a stationary point on the production vessel to avoid undue extension of the flexible riser lines.

The change in heading which is often required by weathervaning is also problematical in that it is difficult to accomplish with conventional, multiple anchor mooring systems because anchor chains must be taken in and paid out to accommodate the change in vessel heading.

Because of the difficulties in changing the vessel heading with multiple anchor mooring systems, known mooring systems employ a centrally mounted swivel which extends completely through the ship from the deck through to the bottom of the vessel. The mooring chains extend through the swivel. When a heading change is required the vessel is effectively rotated about the mooring swivel to a desired heading, the swivel being stationary with respect to the mooring anchors and ocean floor. Typical of such mooring systems are U.S. Pat. Nos. 3,191,201; 3,602,175; 3,440,671; 3,552,343; 3,620,181; 3,605,668; 3,590,407; 3,279,404; and 3,774,562.

Onboard mooring systems have traditionally featured a large well extending from the deck through the bottom of the ship. Due to the size of the opening, the structure of the ship must be specifically engineered to accommodate the size of the opening. In attempting to install an onboard turret mooring system into an existing vessel, the size of the well is so large that the structure of each specific vessel must be analyzed prior to construction. The necessity of the extended engineering and design effort required to retrofit an existing tanker with a large central well may create unacceptable costs and delays in the final delivery of the tanker. Extensive engineering and design effort is required since the openings through the deck and the bottom plating must be very large, in the order of thirty to sixty feet in diameter, to properly transmit the mooring loads into the ship's structure. The presence of such a large opening in the hull adversely effects the longitudinal hull strength of the tanker and often requires significant modifications to achieve the proper desired strength required by regulatory agencies. Additionally, the significant delays encountered due to the engineering and design effort required may sometimes result in the tanker for which the design has been created becoming unavailable. In those situations, the entire design effort is wasted since it was especially tailored for a ship of a particular design.

Since a turret design must be developed with a particular ship in mind, one universal design incorporating several compromises may create significant limitations in flexibility to adapt various mooring line diameters and quantities/size of risers unless the standard unit design is overdesigned for the worst conceivable case. Finally, since a turret mooring system must be specially designed for each ship, firm quotations cannot be obtained from shipyards at the early stage of a project due to the uncertainty about the existing ship's hull structure and how the mooring system will effect such a structure.

Accordingly, the apparatus and method of the present invention address the need for a family of several specific designs which are adaptable for any barge, tanker, drill ship, semi-submersible unit or LNG/LPG carrier for the environmental conditions to be encountered. This family of designs could have a wide range of applicability to various size tankers, such as 50,000 DWT to 400,000 DWT, for example and for service in diverse environmental conditions, such as wave heights of thirty to ninety feet, for example and for a multitude of water depths, such as one hundred to three thousand feet, for example. This family of designs would be suitable for numerous types of vessels such as oil storage barges, existing or proposed drill ships and floating process plants, among others.

SUMMARY OF THE INVENTION

A family of designs which is adapted for retrofitting into existing or newly constructed vessels without substantial structural redesign includes a relatively slender central section or middle turret unit which can be inserted through a small hole through the main deck. The middle turret unit of the present invention is preferably less than twenty feet in diameter as compared to prior designs which ranged from forty to ninety feet in diameter and above. Accordingly, a family of designs suitable for retrofitting into existing vessels which requires only a small hole through the vessel, can be finally designed, model tested, and fabricated before it is known specifically in which vessel the mooring system will be installed. Repetitive engineering and model testing costs and lead time for achieving actual production from a new discovery can be minimized due to the reduced construction time.

The present invention provides a vessel mounted mooring system and a method for its installation. The method involves the construction of a vertical well in the vessel extending from the deck through the bottom plates of the vessel. A lower bearing ring which circumscribes the well is connected to the underside of the bottom plates. A lower turret unit is laterally guided by the lower bearing ring and is restrained against uplift forces by the lower bearing ring. A middle turret unit is placed into the well and connected to the lower turret unit. An upper bearing ring which circumscribes the well is mounted to the deck. The upper turret unit is connected to the middle turret unit whereupon the weight of the assembly of the upper, middle and lower turret units and the vertical component of the mooring and riser forces are supported and guided by the upper bearing ring and further guided by the lower bearing ring. Chain lockers which include chains and windlasses are mounted to the upper turret unit for selectively paying out or reeling in chain through the upper, middle and lower turret unit to allow the chain to be connected near the subsea floor.

DETAILED DESCRIPTION OF THE PREFERRED EMBODIMENT

Figure 1:
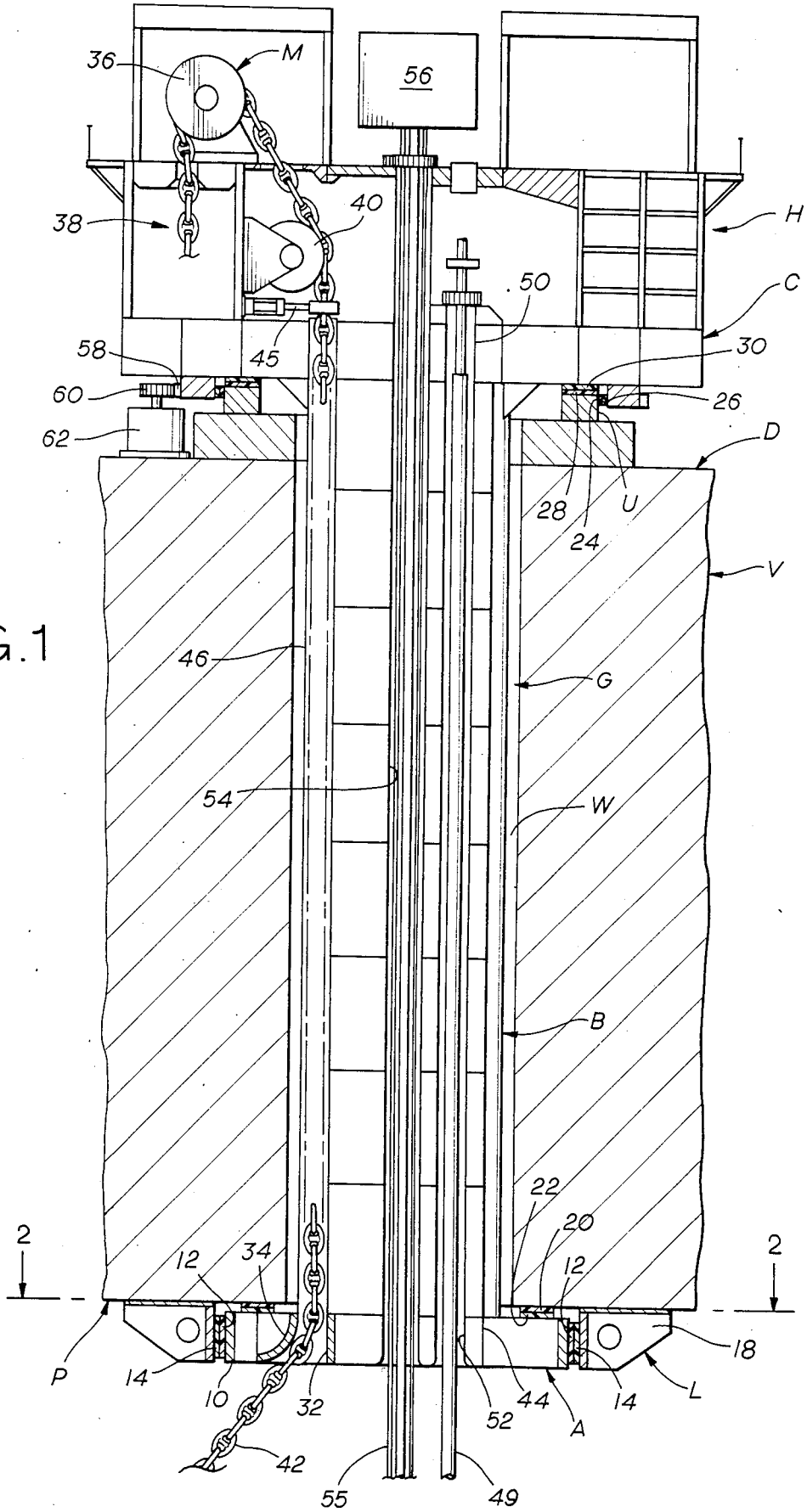
FIG. 1 is a sectional elevational view taken through the center line of the well of the vessel.

In the preferred embodiment, the mooring system H and the method for its installation are illustrated in FIG. 1. FIG. 1 illustrates a sectional view through a vessel V having a deck D and bottom plates P. The bottom plates P extend in a known fashion and are the lower most portion of the vessel. The apparatus of the present invention fits through an opening in the deck D and an opening in bottom plates P. A series of bulkheads G define a substantially vertical opening or well W extending from deck D to bottom plates P.

The mooring system H includes a lower turret unit A, a middle turret unit B and an upper turret unit C. The mooring system H of the present invention further includes a lower bearing ring L and an upper bearing ring U. Mooring means M is connected to upper turret unit C for reeling in and paying out mooring chain, cable or synthetic lines 42 through mooring system H as will be further described hereinbelow.

As seen in FIG. 1, lower turret unit A is fabricated from structural steel components and has an annular shape. Lower turret unit A has an arcuate outer surface 10 whose diameter exceeds that of well W. Lower turret unit A further includes a central core 44 of approximately the same cross-sectional area as well W and is substantially aligned therewith.

Figure 2:
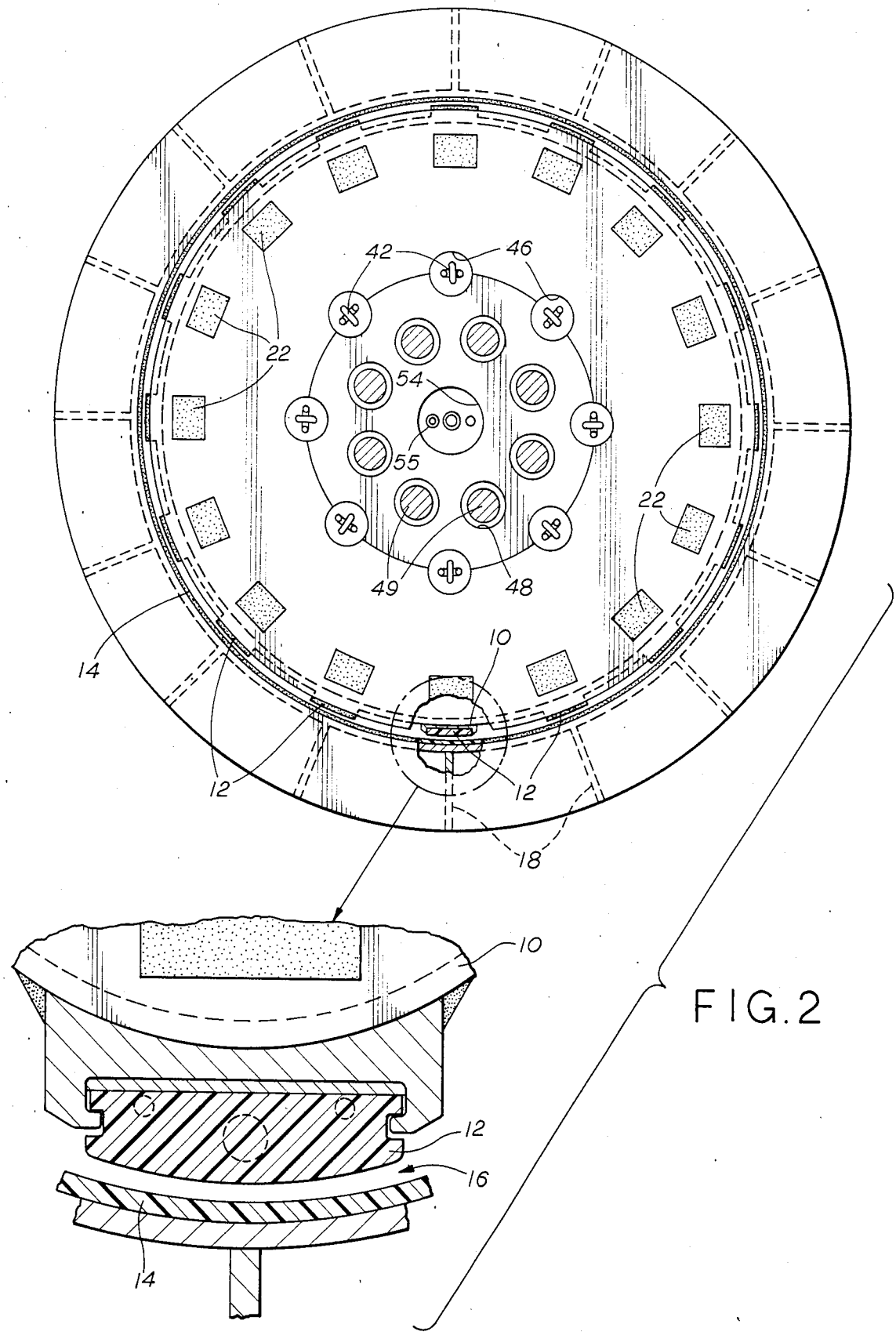
FIG. 2 is a plan view taken along lines 2—2 of FIG. 1 showing a bearing pad in detail.

As seen in FIGS. 1 and 2, lower turret unit A has a plurality of bearing pads 12 connected to the outer surface 10. Preferably, bearing pads 12 can be constructed of an aluminum/bronze alloy although other materials may be used without departing from the spirit of the invention. Lower bearing ring L further includes a continuous annular ring 14. Annular ring 14 circumscribes well W and is disposed in substantial alignment to the walls forming well W. Ring 14 is disposed in a plane substantially parallel to pads 12 with a clearance 16 therebetween (See FIG. 2). A suitable frame structure 18 is connected to the bottom plates P so as to support ring 14. Thus, due to the interaction of pads 12 with ring 14, lower turret unit A is free to rotate within the lower bearing ring L while the interaction between pads 12 and ring 14 laterally guides lower turret unit A within lower bearing ring L.

Lower bearing ring L can also include a second continuous ring 20 which circumscribes the well and is disposed in a plane perpendicular to the longitudinal axis of well W. A plurality of individual bearing pads 22 are secured adjacent to the top most surface of lower turret unit A for interaction with ring 20. Rings 14 and 20 are preferably constructed of stainless steel or inconel, although other materials can be used without departing from the spirit of the invention. The interaction of pads 22 with ring 20 helps to resist uplift forces acting on the assembly of the upper, lower and middle turret units. During certain weather conditions, the vessel may pitch thereby slackening chains 42 and actually exerting an uplifting force on the turret assembly acting in a direction from bottom plates P to deck D. The probability of such occurrence is low. However, in the event of such occurrence the presence of ring 20 and pads 22 act to resist such uplift forces while at the same time allowing relative rotation of the vessel V around a stationary assembly of lower turret unit A, middle turret unit B and upper turret unit C.

Upper turret unit C is mounted above deck D and circumscribes well W. Upper bearing ring U includes a continuous bearing surface 24. Surface 24 is disposed in substantial alignment with well W and in a plane substantially parallel to ring 14. Continuous ring 24 interacts with bearing pads 26. Bearing pads 26 are uniformly distributed along upper turret unit C and in a plane substantially parallel to continuous ring 24. Thus, as a result of the interaction between ring 24 and pads 26, upper turret unit C is laterally restrained while vessel V is permitted to weathervane with respect to the stationary upper turret unit C. In order to support the weight of the assembly of upper turret unit C and the equipment thereon as well as middle turret unit B and lower turret unit A and to support the vertical component of the mooring and riser forces, a continuous bearing ring 28, which is made of stainless steel or another suitable material such as Inconel, is secured to the deck D as part of upper bearing ring U. Ring 28 is disposed in a plane substantially perpendicular to the longidutinal axis of well W. Adjacent the lowermost surface of upper turret unit C, a plurality of bearing pads 30 are disposed in a circular fashion. Pads 30 interact with ring 28 thereby allowing vessel V to weathervane with respect to the stationary upper turret unit C as weather conditions require.

It can readily be seen that the assembly of the lower turret unit A, middle turret unit B and upper turret unit C is effectively laterally guided at its lower end by the interaction of pads 12 with ring 14. Uplift on the assembly is resisted by the interaction of ring 20 with pads 22. The weight of the assembly is supported off deck D by the interaction of ring 28 with pads 30. The assembly is laterally guided above deck D by the interaction of ring 24 with pads 26. As shown in FIG. 2, pads such as 26 and 12 can be removably installed for replacement as they wear. Pads such as 12 can be shimmed as necessary to maintain the proper clearance 16 uniformly around lower turret unit A. The same principle applies to the pads adjacent upper turret unit C.

Lower turret unit A further has an opening 32 for each chain 42 which extends through the assembly. Each chain 42 is connected to an anchor or anchor pile (not shown) which is disposed on the sea bed. A portion of opening 32 comprises curved wearing surface 34. Chain 42 rides against curved wearing surface 34 as chain 42 is reeled in or played out by mooring means M. Mooring means M are disposed above upper turret unit C and include a plurality of windlasses 36. In calmer environments block and tackle assemblies or linear pullers can be substituted for the windlasses 36. Normally, two sets of windlasses are operated simultaneously. Depending on the application, a windlass 36 can be provided for operating each chain 42. However, in some applications to economize the installation, two windlasses can be provided for sequentially reeling in and paying out a selected pair of all the chains 42 employed in the turret mooring system. Each chain 42 is equipped with a chain locker 38 for accumulation of chain 42, as necessary. Additionally, as necessary, an idler roller 40 can be provided to operate with each windlass 36. Each chain 42 is equipped with a chain stopper 45 to maintain the station of chain 42 within a chain tube 46 which extends from upper turret unit C to lower turret unit A. Chain stopper 45 can be of varying design and is usually a hydraulically actuated gripping device which retains chain 42 with respect to chain tube 46.

The assembly of lower turret unit A, middle turret unit B and upper turret unit C has a plurality of risers 49 extending therethrough for permitting flow from subsurface wells to the deck area of vessel V. The risers 49 are distributed in a circular pattern adjacent the periphery of middle turret unit B while extending at their upper end through upper turret unit C and at their lower end through lower turret unit A through openings 50 and 52, respectively. Additionally, a central riser pipe 54 extends through the assembly. Generally speaking, control piping 55 can be routed through central opening 54 for subsea connection to well control devices on the sea bed. Each pipe connection extending through upper turret unit C is connected to a swivel joint, symbolically represented as 56 to allow connections between the stationary upper turret unit and the weathervaning vessel V.

In some applications it may be desirable to quickly bring the vessel V to the proper station with respect to wind and wave activity. In such cases, a gear 58 can be mounted to upper turret unit C. Gears 60 engage gear 58 and are driven by motors 62. Gears 60 and motors 62 are mounted to the deck and as a result of operation of motors 62 relative movement of vessel V occurs with respect to upper turret unit C when upper turret unit C is connected to the subsea floor via chains 42. The gear 58 and the gears 60 and motors 62 also can be used as a mechanical brake to eliminate cyclic oscillation of the vessel V due to minor changes in environmental conditions.

Accordingly, when the assembly of the lower turret unit A, middle turret unit B, and upper turret unit C is connected to vessel V in the manner shown in FIG. 1, the vessel V is free to weathervane about the center line of well W in response to weather conditions and tidal forces. Essentially, lower turret unit A, middle turret unit B and upper turret unit C remain stationary while vessel V rotates about the vertical center line of well W. The forces transmitted to the mooring system H comprising of lower, middle and upper segments A, B and C, respectively, due to winds, waves, currents and other weather conditions including tidal action, are transmitted through mooring lines 42 which are secured to the sea floor in substantially a circular pattern having the center line of well W as its center.

When the mooring system H of the present invention is in place and mooring lines 42 are connected to the subsea floor below vessel V, the assembly of lower turret unit A, middle turret unit B and upper turret unit C is essentially stationary in a lateral direction with respect to the subsea floor. The vessel V is free to weathervane about the center line of well W. The restraint against lateral movement and further the limitation of motion in the vertical direction is necessary in that risers 49 which run through the riser pipes 48 are connected to subsea well completions for production therefrom. These subsea connecting lines, (not shown) have only a limited degree of flexibility and slack. Therefore, it is essential to maintain the station of the vessel with respect to the subsea well site.

The well fluids which are produced from the subsea wells and directed to risers 49 via subsea production lines (not shown), operate at relatively high pressures, especially when fluids are reinjected into the reservoir. A swivel joint as is known in the art 56 is mounted above the upper end of risers 49 and allows a hard pipe connection between essentially stationary risers 49 and moving deck D. It is advantageous to locate the swivel joint above upper turret unit C rather than on the top of buoys as in the past, in that a greater degree of ease is afforded if maintenance is required to swivel joint 56. Furthermore, due to the high pressures involved in production from subsea wells, systems incorporating several production lines will require extremely heavy swivel joints which may limit the practicality of using buoys for connection onto a production ship.

In installing the mooring system H of the present invention into a vessel or barge having a well W extending from the deck D to the bottom plates P, the lower bearing ring L is connected to the underside of bottom plates P. The lower bearing ring L is positioned so that it circumscribes the well and extends below the bottom plates. The lower turret unit A is then placed into position substantially within the lower bearing ring L. The middle turret unit B is placed substantially within the well W and connected to lower turret unit A. Upper turret unit C is lowered onto ring 28 and connected to middle turret unit B. Mooring means M, including chain lockers 38 each including a driver (not shown) for each mooring line 42, is connected to upper turret unit C. Swivel joint 56 is placed above risers 49 in fluid communication therewith to permit hard piping between essentially stationary risers 49 and moving deck D. Lower turret unit A may have to be temporarily supported substantially within lower bearing ring L until middle and upper turret units B and C, respectively can be connected thereto so that the assembly of the entire mooring system H bears upon ring 28 of upper bearing ring U.

Mounting lower bearing ring L below bottom plates P and mounting upper bearing ring U above the deck D permits the employment of a relatively small well W to be built into vessel V. At the same time relatively large diameter bearings can be used for rings 14, 24 and 28. By incorporating a relatively small well W which for example may be as small as ten feet in diameter as compared to 40 to 90 feet in known designs, the mooring system H can be simply retrofitted into existing vessels without the need for substantial structural analysis, and/or redesign. Frequently, timing is critical in retrofitting existing vessels and if a substantial redesign is required, the viability of the entire project may be in question. The mooring system H of the present invention allows shipyards to quickly give firm quotations for retrofits in that a substantial redesign or structural evaluation of the vessel to be retrofitted is not necessary in view of the relatively small size of well W. Furthermore, by locating lower bearing ring L on the underside of bottom plates P, pads 12 are easily accessible to divers to make any necessary repairs or replacement. By employment of prefabrication techniques, the actual retrofit time for a particular vessel is greatly reduced in that the extent of the dry-dock work in view of the small opening required for well W is greatly reduced.

The foregoing disclosure and description of the invention are illustrative and explanatory thereof, and various changes in the size, shape and materials, as well as in the details of the illustrated construction may be made without departing from the spirit of the invention.

We claim:

1. A method of installing a mooring system in newly constructed vessels and retrofitting into existing vessels, comprising:

installing a vertical well extending from the deck of the vessel to the bottom plates of the vessel, the ratio of the opening of the well to the width of the deck adjacent said well being in the ratio of 1:5 to 1:10, connecting a lower bearing ring adjacent to the underside of said bottom plates said lower bearing ring circumscribing said well;

placing a lower turret unit substantially within said lower bearing ring, said lower turret unit having an annular shape with a larger cross-sectional area, in a plane perpendicular to the longitudinal axis of said well, than said well, said lower turret unit rotatably mounted to said lower bearing ring for lateral guidance and prevention of uplift of said lower turret unit in a direction from said bottom plates to said deck;

placing a middle turret unit substantially within said well;

connecting said middle turret unit to said lower turret unit;

connecting an upper bearing ring adjacent to the top of the deck, said upper bearing ring circumscribing said well; and connecting an upper turret unit to said middle turret unit, said upper turret unit having an annular shape with a larger cross-sectional area, in a plane perpendicular to the longitudinal axis of said well, than said well, said upper turret unit rotatably mounted to said upper bearing ring for lateral guidance thereof and for support of the weight of the assembly of said upper, middle and lower turret units;

whereupon the vessel can be continuously moored in seas having wave heights as great as ninety to one hundred feet.

2. The method of claim 1 wherein the installation of said lower bearing ring further includes the step of:

mounting a first continuous annular ring adjacent to the bottom plates of said deck, said first continuous annular ring circumscribing said well and having a bearing surface disposed in substantial concentric alignment to said well.

3. The method of claim 2 wherein installing said lower turret unit further includes the step of:

installing a plurality of first bearing pads to the outer periphery of said lower turret unit said first bearing pads disposed substantially concentrically to said first continuous annular ring, thereby allowing said lower turret unit to rotate with respect to said lower bearing ring while being guided by said lower bearing ring due to the interaction of said first continuous annular ring and said first bearing pads.

4. The method of claim 3 wherein installation of said upper bearing ring further includes the step of:

mounting a second continuous annular ring adjacent to said deck, said second continuous annular ring circumscribing said well and disposed in a plane substantially perpendicular to the longitudinal axis of said well.

5. The method of claim 4 wherein installation of said upper turret unit further includes the step of:

installing a plurality of second bearing pads adjacent to the lowermost surface of said upper turret unit, said second bearing pads disposed in a plane substantially parallel to said second continuous annular ring and in running contact therewith, thereby allowing the assembly of said upper, lower, and middle turret units to be supported from and rotate with respect to said deck.

6. The method of claim 5 wherein installation of said upper bearing ring further includes the step of:

installing a third continuous annular ring secured adjacent said deck, said third continuous annular ring disposed in substantial concentric alignment to said well while circumscribing said well.

7. The method of claim 6 wherein installation of said upper turret unit further includes the step of:

installing a plurality of third bearing pads to said upper turret unit substantially concentrically to said third continuous annular ring, thereby providing lateral guidance to said upper turret unit due to the interaction of said third continuous bearing ring and said third bearing pads while allowing said upper turret unit to rotate with respect to said deck.

8. The method of claim 7 wherein installation of said lower bearing ring further includes the step of:

installing a fourth continuous annular ring adjacent the bottom plates of said deck, said fourth ring disposed in a plane perpendicular to the longitudinal axis of said well and circumscribing said well.

9. The method of claim 8, wherein installation of said lower turret unit further includes the step of:

installing a plurality of fourth bearing pads adjacent to the topmost surface of said lower turret unit and in a plane substantially parallel to said fourth continuous annular ring, whereupon said lower turret unit is prevented from being uplifted in a direction from said bottom plates to said deck while rotating with respect to said first and fourth continuous annular rings.

10. The method of claim 9 further includes the steps of:

installing a plurality of chain pipes in said lower, middle, and upper turret units extending substantially in a direction parallel to the longitudinal axis of said well;

installing at least one riser pipe substantially parallel to said chain pipes, said riser pipe extending from said upper turret unit to said lower turret unit; and wherein the step of connecting said upper turret unit further includes the step of:

installing a plurality of chain drives on said upper turret unit each said chain drive adapted to pay out and reel in a chain through one of said chain pipes for securing the assembly of said upper, middle, and lower turret units to the subsea floor while allowing the vessel to rotate about said upper, middle, and lower turret units.

11. The method of claim 10 further including the step of:

securing a swivel joint onto said upper turret unit said swivel joint in fluid communication with said riser pipe.

12. A method of installing a mooring system in a vessel having a vertical well extending from the deck of the vessel to the bottom plates of the vessel comprising:

connecting a lower bearing ring adjacent to the underside of said bottom plates said lower bearing ring circumscribing said well;

placing a lower turret unit substantially within said lower bearing ring, said lower turret unit having an annular shape with a larger cross-sectional area, in a plane perpendicular to the longitudinal axis of said well, than said well, said lower turret unit rotatably mounted to said lower bearing ring for lateral guidance and prevention of uplift of said lower turret unit in a direction from said bottom plates to said deck;

placing a middle turret unit substantially within said well;

connecting said middle turret unit to said lower turret unit;

connecting an upper bearing ring adjacent to the top of the deck, said upper bearing ring circumscribing said well; and connecting an upper turret unit to said middle turret unit, said upper turret unit having an annular shape with a larger cross-sectional area, in a plane perpendicular to the longitudinal axis of said well, than said well, said upper turret unit rotatably mounted to said upper bearing ring for lateral guidance thereof and for support of the weight of the assembly of said upper, middle and lower turret units;

mounting a first continuous annular ring adjacent to the bottom plates of said deck, said first continuous annular ring circumscribing said well and having a bearing surface disposed in substantial concentric alignment to said well;

installing a plurality of first bearing pads to the outer periphery of said lower turret unit said first bearing pads disposed substantially concentrically to said first continuous annular ring, thereby allowing said lower turret unit to rotate with respect to said lower bearing ring while being guided by said lower bearing ring due to the interaction of said first continuous annular ring and said first bearing pads;

mounting a second continuous annular ring adjacent to said deck, said second continuous annular ring circumscribing said well and disposed in a plane substantially perpendicular to the longitudinal axis of said well;

installing a plurality of second bearing pads adjacent to the lowermost surface of said upper turret unit, said second bearing pads disposed in a plane substantially parallel to said second continuous annular ring and in running contact therewith, thereby allowing the assembly of said upper, lower, and middle turret units to be supported from and rotate with respect to said deck;

installing a third continuous annular ring secured adjacent said deck, said third continuous annular ring disposed in substantial concentric alignment to said well while circumscribing said well;

installing a plurality of third bearing pads to said upper turret unit substantially concentrically to said third continuous annular ring, thereby providing lateral guidance to said upper turret unit due to the interaction of said third continuous bearing ring and said third bearing pads while allowing said upper turret unit to rotate with respect to said deck;

installing a fourth continuous annular ring adjacent the bottom plates of said deck, said fourth ring disposed in a plane perpendicular to the longitudinal axis of said well and circumscribing said well;

installing a plurality of fourth bearing pads adjacent to the topmost surface of said lower turret unit and in a plane substantially parallel to said fourth continuous annular ring, whereupon said lower turret unit is prevented from being uplifted in a direction from said bottom plates to said deck while rotating with respect to said first and fourth continuous annular rings;

installing a plurality of chain pipes in said lower, middle, and upper turret units extending substantially in a direction parallel to the longitudinal axis of said well;

installing at least one riser pipe substantially parallel to said chain pipes, said riser pipe extending from said upper turret unit to said lower turret unit; and wherein the step of connecting said upper turret unit further includes the step of:

installing a plurality of chain drives on said upper turret unit each said chain drive adapted to pay out and reel in a chain through one of said chain pipes for securing the assembly of said upper, middle, and lower turret units to the subsea floor while allowing the vessel to rotate about said upper, middle, and lower turret units;

securing a swivel joint onto said upper turret unit said swivel joint in fluid communication with said riser pipe;

addition of a plurality of arcuate wear surfaces extending from substantially the top to substantially the bottom of said lower turret unit, each chain extending through a chain pipe and guided through said lower turret unit by contact with one of said arcuate wear surfaces; and installation of said upper turret unit further includes the steps of:

installing a gear on said upper turret unit;

installing a deck mounted motor driven gear to engage said gear on said upper turret unit thereby causing the vessel to weathervane about an anchored upper turret unit.

13. A vessel mooring system for newly constructed vessels and for retrofitting on existing vessels, said vessels having a deck, bottom plates, a well extending substantially vertically from said deck to said bottom plates below the vessel's water line comprising:

a lower turret unit rotatably mounted below said bottom plates, said lower turret unit having an annular shape with a larger cross-sectional area in a plane substantially perpendicular to the longitudinal axis of said well, than said well;

lower bearing means circumscribing said well and extending below said bottom plates for laterally guiding said lower turret unit and for counteracting uplift forces on said lower turret unit in a direction from said bottom plates toward said deck, said lower bearing means connected to said bottom plates of said vessel;

a middle turret unit connected to the top of said lower turret unit and disposed substantially within said well, said middle turret unit having a substantially smaller cross-sectional area than the cross-sectional area of said lower turret unit in a plane perpendicular to the longitudinal axis of said well;

the ratio of the opening of said well to the width of the deck adjacent said well being in the range of 1:5 to 1:10, an upper turret unit connected to said middle turret unit and disposed substantially above said deck of said vessel, said upper turret unit having an annular shape with a larger cross-sectional area in a plane perpendicular to the longitudinal axis of said well, than said well; and upper bearing means mounted to the top of said deck circumscribing said well for supporting the weight of the connected assembly of said upper, middle, and lower turret units above said deck and laterally guiding said upper turret unit;

whereupon the vessel can be moored in seas having wave heights as great as ninety to one hundred feet.

14. The vessel mooring system of claim 13 further comprising:

mooring means extending through said upper, middle and lower turret units for anchoring said vessel to the bottom of a body of water.

15. The vessel mooring system of claim 14 wherein said lower bearing means further comprises:

a first continuous annular ring mounted adjacent the bottom plates of said deck, said first continuous annular ring circumscribing said well and having a bearing surface disposed in substantial concentric alignment to said well.

16. The vessel mooring system of claim 15 wherein said lower turret unit further comprises:

a plurality of first bearing pads mounted to the outer periphery of said lower turret unit said first bearing pads disposed substantially concentrically to said first continuous annular ring, thereby allowing said lower turret unit to rotate with respect to said lower bearing means while being guided by said lower bearing means due to the interaction of said first continuous annular ring and said first bearing pads.

17. The vessel mooring system of claim 16 wherein said upper bearing means further comprises:

a second continuous annular ring adjacent said deck, said second continuous annular ring circumscribing said well and disposed in a plane substantially perpendicular to the longitudinal axis of said well.

18. The vessel mooring system of claim 17 wherein said upper turret unit further comprises:

a plurality of second bearing pads mounted adjacent to the lowermost surface of said upper turret unit, said second bearing pads disposed in a plane substantially parallel to said second continuous annular ring and in running contact therewith, thereby allowing the assembly of said upper, lower, and middle turret units to be supported from and rotate with respect to said deck.

19. The vessel mooring system of claim 18 wherein said upper bearing means further comprises:

a third continuous annular ring secured adjacent said deck, said third continuous annular ring disposed in substantial concentric alignment to said well while circumscribing said well.

20. The vessel mooring system of claim 19 wherein said upper turret unit further comprises:

a plurality of third bearing pads mounted to said upper turret unit substantially concentrically to said third continuous annular ring, thereby providing lateral guidance to said upper turret unit due to the interaction of said third continuous annular ring and said third bearing pads while allowing said upper turret unit to rotate with respect to said deck.

21. The vessel mooring system of claim 20 wherein said lower bearing means further comprises:

a fourth continuous annular ring adjacent the bottom plates, said fourth ring disposed in a plane perpendicular to the longitudinal axis of said well and circumscribing said well.

22. The vessel mooring system of claim 21, wherein said lower turret unit further comprises:

a plurality of fourth bearing pads adjacent to the topmost surface of said lower turret unit and in a plane substantially parallel to said fourth continuous annular ring, whereupon said lower turret unit is prevented from being uplifted in a direction from said bottom plates to said deck while rotating with respect to said first and fourth continuous annular rings.

23. The vessel mooring system of claim 22 further comprises:

a plurality of chain pipes in said lower, middle, and upper turret units extending substantially in a direction parallel to the longitudinal axis of said well;

at least one riser pipe substantially parallel to said chain pipes, said riser pipe extending from said upper turret unit to said lower turret unit; and a plurality of chain drives on said upper turret unit each said chain drive adapted to pay out and reel in a chain through one of said chain pipes for securing the assembly of said upper, middle, and lower turret units to the subsea floor while allowing the vessel to rotate about said upper, middle, and lower turret units.

24. The vessel mooring system of claim 23 further comprising:

a swivel joint mounted to said upper turret unit said swivel joint in fluid communication with said riser pipe.

25. A vessel mooring system for a vessel having a deck, bottom plates, a well extending substantially vertically from said deck to said bottom plates below the vessel's water line comprising:

a lower turret unit rotatably mounted below said bottom plates, said lower turret unit having an annular shape with a larger cross-sectional area in a plane substantially perpendicular to the longitudinal axis of said well, than said well;

lower bearing means circumscribing said well and extending below said bottom plates for laterally guiding said lower turret unit and for counteracting uplift forces on said lower turret unit in a direction from said bottom plates toward said deck, said lower bearing means connected to said bottom plates of said vessel;

a middle turret unit connected to the top of said lower turret unit and disposed substantially within said well, said middle turret unit having a substantially smaller cross-sectional area than the cross-sectional area of said lower turret unit in a plane perpendicular to the longitudinal axis of said well;

an upper turret unit connected to said middle turret unit and disposed substantially above said deck of said vessel, said upper turret unit having an annular shape with a large cross-sectional area in a plane perpendicular to the longitudinal axis of said well, than said well; and upper bearing means mounted to the top of said deck circumscribing said well for supporting the weight of the connected assembly of said upper, middle, and lower turret units above said deck and laterally guiding said upper turret unit;

mooring means extending through said upper, middle and lower turret units for anchoring said vessel to the bottom of a body of water;

said lower bearing means further comprises:

a first continuous annular ring mounted adjacent the bottom plates of said deck, said first continuous annular ring circumscribing said well and having a bearing surface disposed in substantial concentric alignment to said well;

said lower turret unit further comprises:

a plurality of first bearing pads mounted to the outer periphery of said lower turret unit said first bearing pads disposed substantially concentrically to said first continuous annular ring, thereby allowing said lower turret unit to rotate with respect to said lower bearing means while being guided by said lower bearing means due to the interaction of said first continuous annular ring and said first bearing pads;

said upper bearing means further comprises:

a second continuous annular ring adjacent said deck, said second continuous annular ring circumscribing said well and disposed in a plane substantially perpendicular to the longitudinal axis of said well;

said upper turret unit further comprises:

a plurality of second bearing pads mounted adjacent to the lowermost surface of said upper turret unit, said second bearing pads disposed in a plane substantially parallel to said second continuous annular ring and in running contact therewith, thereby allowing the assembly of said upper, lower, and middle turret units to be supported from and rotate with respect to said deck;

said upper bearing means further comprises:

a third continuous annular ring secured adjacent said deck, said third continuous annular ring disposed in substantial concentric alignment to said well while circumscribing said well;

said upper turret unit further comprises:

a plurality of third bearing pads mounted to said upper turret unit substantially concentrically to said third continuous annular ring, thereby providing lateral guidance to said upper turret unit due to the interaction of said third continuous annular ring and said third bearing pads while allowing said upper turret unit to rotate with respect to said deck;

said lower bearing means further comprises:

a fourth continuous annular ring adjacent the bottom plates, said fourth ring disposed in a plane perpendicular to the longitudinal axis of said well and circumscribing said well;

said lower turret unit further comprises:

a plurality of fourth bearing pads adjacent to the topmost surface of said lower turret unit and in a plane substantially parallel to said fourth continuous annular ring, whereupon said lower turret unit is prevented from being uplifted in a direction from said bottom plates to said deck while rotating with respect to said first and fourth continuous annular rings;

a plurality of chain pipes in said lower, middle, and upper turret units extending substantially in a direction parallel to the longitudinal axis of said well;

at least one riser pipe substantially parallel to said chain pipes, said riser pipe extending from said upper turret unit to said lower turret unit; and a plurality of chain drives on said upper turret unit each said chain drive adapted to pay out and reel in a chain through one of said chain pipes for securing the assembly of said upper, middle, and lower turret units to the subsea floor while allowing the vessel to rotate about said upper, middle, and lower turret units;

a swivel joint mounted to said upper turret unit said swivel joint in fluid communication with said riser pipe;

said lower turret unit further comprises:

arcuate wear surfaces extending from substantially the top to substantially the bottom of said lower turret unit, each chain extending through a chain pipe and guided through said lower turret unit by contact with one of said arcuate wear surfaces;

said upper turret unit further comprising, a first gear; and a second gear secured to said deck and operably connected to said first gear for weathervaning the vessel when said assembly of said upper, middle and lower turret units is anchored to the subsea floor.

* * * * *